US011519600B2

(12) United States Patent
Tadakuma et al.

(10) Patent No.: US 11,519,600 B2
(45) Date of Patent: Dec. 6, 2022

(54) SOLID FUEL BURNER AND FLAME STABILIZER FOR SOLID FUEL BURNER

(71) Applicant: MITSUBISHI HITACHI POWER SYSTEMS, LTD., Yokohama (JP)

(72) Inventors: Satoshi Tadakuma, Yokohama (JP); Akira Baba, Yokohama (JP); Koji Kuramashi, Yokohama (JP); Takeshi Aruga, Yokohama (JP); Shohei Mito, Yokohama (JP); Kosuke Kitakaze, Yokohama (JP); Toshihiko Mine, Yokohama (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 168 days.

(21) Appl. No.: 16/957,913

(22) PCT Filed: Dec. 18, 2018

(86) PCT No.: PCT/JP2018/046599
§ 371 (c)(1),
(2) Date: Jun. 25, 2020

(87) PCT Pub. No.: WO2019/131335
PCT Pub. Date: Jul. 4, 2019

(65) Prior Publication Data

US 2020/0363058 A1 Nov. 19, 2020

(30) Foreign Application Priority Data

Dec. 26, 2017 (JP) ..... JP2017-249739

(51) Int. Cl.
*F23C 9/00* (2006.01)

(52) U.S. Cl.
CPC ..... *F23C 9/003* (2013.01); *F23C 2700/063* (2013.01); *F23D 2201/10* (2013.01); *F23D 2209/20* (2013.01)

(58) Field of Classification Search
None
See application file for complete search history.

(56) References Cited

U.S. PATENT DOCUMENTS 3,399,950 A * 9/1968 Martin ..... F23D 17/00 431/153
4,545,307 A 10/1985 Morita et al.
(Continued)

FOREIGN PATENT DOCUMENTS

JP 60-226609 A 11/1985
JP 62-80409 A 4/1987
(Continued)

OTHER PUBLICATIONS

International Search Report dated Apr. 2, 2019, issued in counterpart International Application No. PCT/JP2018/046599. (4 pages).

*Primary Examiner* — Jason Lau
(74) *Attorney, Agent, or Firm* — WHDA, LLP

(57) ABSTRACT

A solid fuel burner is provided with a guide member arranged on an outer circumferential section of a distal end of a first gas nozzle so as to guide a fluid flowing through a second flow passage outward in a radial direction; and a contraction forming member that is arranged on an upstream side of the guide member with respect to the flow direction of the second flow passage so as to reduce the cross sectional area of the second flow passage. An outer diameter of the guide member is formed to be smaller than an inner diameter of an outer peripheral wall of a second gas nozzle. The first gas nozzle, the guide member, and the contraction forming member are configured so as to be integrally attachable/
(Continued)

detachable along an axial direction of the first gas nozzle toward the outside of a furnace.

4 Claims, 6 Drawing Sheets

(56) References Cited

U.S. PATENT DOCUMENTS

| | | | | | |
|---|---|---|---|---|---|
| 5,199,355 | A | | 4/1993 | Larue | |
| 6,112,676 | A | * | 9/2000 | Okazaki | F23D 1/00 431/185 |

FOREIGN PATENT DOCUMENTS

| | | | | | |
|---|---|---|---|---|---|
| JP | 2-115618 | U | | 9/1990 | |
| JP | 5-231617 | A | | 9/1993 | |
| JP | 2000-130710 | A | | 5/2000 | |
| JP | 3344694 | B2 | | 11/2002 | |
| JP | 3643461 | B2 | | 4/2005 | |
| JP | 2013-29270 | A | | 2/2013 | |
| WO | WO-2013018328 | A1 | * | 2/2013 | F23D 1/00 |
| WO | 2018/034286 | A1 | | 2/2018 | |

* cited by examiner

FIG. 5(E) VELOCITY OF SECONDARY AIR IN A-A CROSS SECTION

FIG. 5(F) SIZE OF CIRCULATION REGION

SOLID FUEL BURNER AND FLAME STABILIZER FOR SOLID FUEL BURNER

TECHNICAL FIELD

The present invention relates to a solid fuel burner and a flame stabilizer for a solid fuel burner, and particularly to a solid fuel burner having excellent maintainability and a structure of a flame stabilizer for the solid fuel burner.

BACKGROUND ART

In solid fuel burners which are provided on a wall surface of a furnace such as a boiler to burn solid fuel particles such as pulverized coal obtained by pulverizing coal, a burner having a structure, in which a solid-gas two-phase flow of solid fuel particles from a cylindrical fuel nozzle that opens toward the furnace and a carrier gas thereof is sprayed, and a combustion gas is sprayed from a combustion gas nozzle formed on an outer peripheral side of the fuel nozzle in a coaxial cylindrical shape toward the furnace, is known in the art.

In such a burner, a flame stabilizer is often provided at a tip portion of the fuel nozzle on the furnace opening side as a member for promoting ignition and stabilizing flame. In addition, the flame stabilizer often employs a structure in which it spreads in a stepped shape or with an angle in a radial direction with respect to a fuel flow direction. (Techniques described in Patent Documents 1 to 5 below are known in the art.)

Further, a term "primary air" and a term "secondary air" are commonly used for the above-described term "carrier gas" and the term "combustion gas," respectively, which may be referred to as such terms below. However, in practice, not only the air, and a mixed gas of air and another gas, for example, a combustion exhaust gas is also used.

In addition, in relation to the term "flame stabilizer," an annular flame stabilizer is referred to as a flame stabilization ring or a ring stabilizer, and an annular member as a part of the flame stabilizer is also referred to as a ring or a ring member.

A throttle (venturi) which increases a velocity of the solid-gas two-phase flow to prevent backfire, or as a means for concentrating the solid fuel particles on an inner wall side of the fuel nozzle so as to maintain ignitability of the fuel and stability of the flame especially even at the time of a low load, an interior object such as a fuel concentrator or a swirler which narrows a flow passage in the nozzle radially outward is often installed inside the fuel nozzle.

In addition, the flame stabilizer at the tip portion of the nozzle often has a guide member (guide plate) formed therein to expand the flow of the combustion gas (secondary air) sprayed from the outer peripheral side outward from a central axis side of the nozzle. The guide plate is often used as a name of a baffle plate.

This plate has a purpose to promote ignition of fuel particles, improve stability of the flame, reduce a generation amount of NOx due to an expansion of a reduction flame region, and reduce unburned components, by separating the solid-gas two-phase flow and the flow of combustion gas to form a large circulation flow on the furnace side of the flame stabilizer.

As a typical example, there is a flame stabilizer, as described in Patent Document 1 (a ninth embodiment, FIG. 10, a thick part (303)), and Patent Document 2 (FIG. 1; a flame stabilizer base material (23a), and a flame stabilizer sleeve 23b)), in which a flow passage of the combustion gas nozzle (secondary air nozzle) is formed at a starting end portion thereof so as to reduce the flow of the combustion gas (secondary air) to the outer peripheral side.

By such the flow passage configuration, the velocity of the combustion gas flowing near the flame stabilizer and the guide member thereof is increased, such that cooling of the flame stabilizer and the guide member thereof is promoted and burnout thereof is suppressed, as well as the ignition is stabilized by expanding the above-described circulation flow.

PRIOR ART DOCUMENT

Patent Document

Patent Document 1: Japanese Patent No. 3344694 ([0019], [0064]-[0065], and FIGS. 1 and 11)
Patent Document 2: Japanese Unexamined Patent Application Publication No. 2013-29270 (FIGS. 1, 3 and 4)
Patent Document 3: Japanese Unexamined Patent Application Publication No. S62-80409 (FIG. 1)
Patent Document 4: Japanese Unexamined Utility Model Application Publication No. H2-115618 (FIGS. 1 and 3)
Patent Document 5: Japanese Patent No. 3643461 (FIG. 1)

SUMMARY OF INVENTION

Technical Problem

However, each member such as the above-described interior object and the flame stabilizer provided in the fuel nozzle is inevitably worn out due to use, and there is a need to regularly inspect and perform maintenance such as repair or replacement.

In particular, the flame stabilizer and the guide member thereof receive radiation from the furnace and are exposed to a significantly high temperature, such that maintenance thereof is highly necessary.

Meanwhile, in order for the flame stabilizer and the guide member thereof to sufficiently achieve the above-described function and purpose, it is important to reliably deflect a flow direction of the combustion gas (secondary air) in which a velocity component in a nozzle axial direction is increased by passing through the narrowed flow passage, thereby separating it from the flow of the solid-gas two-phase flow (primary air) to develop a large circulation flow on the furnace side of the flame stabilizer.

Therefore, it was necessary to form a flow passage of the guide member in such a way that a projection surface thereof viewed from the furnace opening side is sufficiently large so that the flow of the combustion gas (secondary air) might not go straight and penetrate from an upstream side of the nozzle toward the furnace side.

Thereby, the outermost diameters of the flame stabilizer and the guide member thereof become larger than an inner diameter of the combustion gas nozzle (secondary air nozzle).

The flame stabilizer and the guide member thereof are integrally formed by casting, and are often attached to an open end portion of the fuel nozzle through an attachment member.

At this time, when outer diameters of the flame stabilizer and the guide member are larger than the inner diameter of an outer peripheral wall of the secondary air nozzle as in the configurations described in Patent Documents 1 and 2, the fuel nozzle portion including the flame stabilizer, and the like cannot be directly pulled out to an outside of the furnace in the axial direction. Accordingly, there is a need to remove the flame stabilizer and the guide member thereof by installing a scaffold inside the boiler furnace, and therefore it is necessary to improve maintainability.

It is a technical object of the present invention to implement a flame stabilizer for a solid fuel burner and a solid fuel burner including the same, which can simultaneously achieve the following 1) to 3).

1) Performance: By forming a large circulation flow on a furnace side of the flame stabilizer, to promote ignition of fuel particles, improve stability of the flame, reduce a generation amount of NOx due to an expansion of a reduction flame region, and reduce unburned components and the like.

2) Reliability: To promote cooling of the flame stabilizer and a guide member thereof to suppress burnout.

3) Maintainability: To pull out the flame stabilizer and the guide member thereof integrally with the fuel nozzle to an outside of the furnace, without removing them from the fuel nozzle.

Solution to Problem

The above object of the present invention can be achieved by employing the following constitutions.

An invention of a first aspect of the present invention is a solid fuel burner including: a first gas nozzle having a cylindrical flow passage through which a mixed fluid of a solid fuel and a carrier gas of the solid fuel flows; a second gas nozzle configured to form a second flow passage through which a combustion gas of the solid fuel flows, and is formed on an outer peripheral side of the first gas nozzle; a guide member disposed on an outer peripheral portion of a tip of the first gas nozzle to guide a fluid flowing through the second flow passage radially outward; and a contraction forming member disposed on an upstream side of the guide member with respect to a flow direction of the second flow passage, to narrow a cross-sectional area of the second flow passage, wherein an outer diameter of the guide member is formed to be smaller than an inner diameter of an outer peripheral wall of the second gas nozzle, and the first gas nozzle, the guide member, and the contraction forming member are configured to be integrally attachable/detachable toward an outside of the furnace in an axial direction of the first gas nozzle.

An invention of a second aspect of the present invention is the solid fuel burner according to the first aspect of the present invention, wherein, when setting the inner diameter of the outer peripheral wall of the second gas nozzle to be L1, the outer diameter of the guide member to be L2, and an inner diameter of the contraction forming member to be L4, these diameters have a relationship as below: L1>L2>L4.

An invention of a third aspect of the present invention is the solid fuel burner according to the first or second aspect of the present invention, wherein the solid fuel burner further includes a fin member which is disposed between the contraction forming member and the guide member to rectify the secondary air flowing through the second flow passage.

An invention of a fourth aspect of the present invention is the solid fuel burner according to the third aspect of the present invention, wherein the solid fuel burner further includes a contraction forming member supported by the fin member.

An invention of a fifth aspect of the present invention is a flame stabilizer provided at an opening end portion of a fuel nozzle of a solid fuel burner having a cylindrical first gas nozzle through which a mixed fluid of a solid fuel and a carrier gas flows and a second gas nozzle disposed on an outer peripheral side of the first gas nozzle, the flame stabilizer for the solid fuel burner including: an annular contraction forming member configured to reduce a flow passage for a combustion gas which flows on an outer peripheral side of the flame stabilizer inward from an outside; a plurality of fin members which extend in a direction along a flow of the combustion gas and are provided in the flame stabilizer in a circumferential direction thereof and a guide member provided to deflect the flow of the combustion gas passing through the annular contraction forming member outward, wherein an outer diameter of the guide member is larger than an inner diameter of the annular contraction forming member, and the first gas nozzle, the guide member, and the contraction forming, member are configured to be integrally attachable/detachable toward an outside of the furnace in an axial direction of the first gas nozzle.

An invention of a sixth aspect of the present invention is a flame stabilizer provided at an opening end portion of a fuel nozzle of a solid fuel burner, the flame stabilizer for the solid fuel burner including: an annular contraction forming member configured to reduce a flow passage for a combustion gas which flows on an outer peripheral side of the flame stabilizer inward from an outside; a plurality of fin members which extend in a direction along a flow of the combustion gas and are provided in the flame stabilizer in a circumferential direction thereof; and a guide member provided to deflect the flow of the combustion gas passing through the annular contraction forming member outward, wherein an outer diameter of the guide member is larger than an inner diameter of the annular contraction forming member, and is an outer diameter or less of the annular contraction forming member.

Advantageous Effects

In accordance with the invention according to the first aspect of the present invention, the outer diameter of the guide member is formed smaller than the inner diameter of the outer peripheral wall of the second gas nozzle, such that the first gas nozzle can be pulled out toward an outside of the furnace without the guide member being caught by the second gas nozzle. Thereby, it is not necessary to assemble a scaffold in the furnace, and the maintainability may be improved. Further, since the fluid passing through the contraction forming member in the second flow passage reaches the guide member in a state in which the velocity thereof becomes high to be guided radially outward, as compared to a case in which there is no contraction forming member, the radial deflection is strong, and even if the outer diameter of the guide member is smaller than the inner diameter of the outer peripheral wall of the second gas nozzle, decreasing the circulation flow is reduced. Thereby, the stability of the flame may be secured, a sufficient circulation flow may be secured, and low NOx properties may be secured. Further, since the fluid reaches the guide member at a high speed, cooling of the guide member and the flame stabilizer is promoted, and burnout is suppressed. Accordingly, reliability may be improved.

Therefore, in accordance with the invention according to the first aspect of the present invention, it is possible to simultaneously achieve the performance, reliability, and maintainability.

In accordance with the invention according to the second aspect of the present invention, the relationship of L1>L2>L4 is satisfied, the first gas nozzle may be pulled out, and a sufficient circulation flow may be secured.

In accordance with the invention according to the third aspect of the present invention, in addition to the effect of the first or second aspect of the present invention, fluid disturbed during the contraction is rectified by the fin member, such that the radial deflection may be increased, and the stability of the flame and the circulation flow may be secured.

In accordance with the invention according to the fourth aspect of the present invention, in addition to the effect of the third aspect of the present invention, the contraction forming member is supported by the fin member, such that it is not necessary to provide a separate support member for supporting the contraction forming member, and the number of components may be reduced.

In accordance with the invention according to the fifth aspect of the present invention, the contraction forming member provided in the flame Stabilizer includes the plurality of fin members extending in the direction along the flow of the combustion gas in the circumferential direction of the flame stabilizer, as well as the guide member is provided to deflect the flow of the combustion gas passing through the annular contraction forming member outward, the outer diameter of the guide member is larger than the inner diameter of the annular contraction forming member, and the guide member, the contraction forming member and the first gas nozzle are integrally attachable/detachable, such that it is possible to pull out the first nozzle on which the flame stabilizer is supported toward the outside of the furnace. Thereby, it is not necessary to assemble a scaffold in the furnace, and the maintainability may be improved. Further, since the fluid passing through the contraction forming member reaches the guide member in a state in which the flow rate thereof becomes high to be guided radially outward, as compared to the case in which there is no contraction forming member, the radial deflection is strong. Thereby, the stability of the flame may be secured, a sufficient circulation flow may be secured, and low NOx properties may be secured. Further, since the fluid reaches the guide member at a high speed, cooling of the guide member and the flame stabilizer is promoted, and burnout is suppressed. Accordingly, reliability may be improved. Therefore, in accordance with the invention according to the fifth aspect of the present invention, it is possible to simultaneously achieve the performance, reliability, and maintainability.

In accordance with the invention according to the sixth aspect of the present invention, the contraction forming member provided in the flame stabilizer includes the plurality of fin members extending in the direction along the flow of the combustion gas in the circumferential direction of the flame stabilizer, as well as the guide member is provided to deflect the flow of the combustion gas passing through the annular contraction forming, member outward, and the outer diameter of the guide member is larger than the inner diameter of the annular contraction forming member and is an outer diameter or less of the annular contraction forming member, such that it is possible to pull out each nozzle on which the flame stabilizer is supported toward the outside of the furnace. Thereby, it is not necessary to assemble a scaffold in the furnace, and the maintainability may be improved. Further, since the fluid passing through the contraction forming member reaches the guide member in a state in which the flow rate thereof becomes high to be guided radially outward, as compared to the case in which there is no contraction forming member, the radial deflection is strong. Thereby, the stability of the flame may be secured, a sufficient circulation flow may be secured, and low NOx properties may be secured. Further, since the fluid reaches the guide member at a high speed, cooling of the guide member and the flame stabilizer is promoted, and the burnout is suppressed. Thereby, reliability may be improved. Therefore, in accordance with the invention according to the sixth aspect of the present invention, it is possible to simultaneously achieve the performance, reliability, and maintainability.

BRIEF DESCRIPTION OF DRAWINGS

FIGS. 1(A)-(C) are a side view (partial cross-section) of a solid fuel burner according to an embodiment of the present invention, wherein FIG. 1(A) is an overall view, FIG. 1(B) is an enlarged view of a tip portion, and FIG. 1(C) is an explanatory view of a positional relationship between respective parts of the tip portion.

FIGS. 3(A)-(B) are explanatory views of contraction forming members of embodiments, wherein FIG. 3(A) is an explanatory view of a contraction forming member of Embodiment 1, and FIG. 3(B) is an explanatory view of a contraction forming member of another embodiment.

FIGS. 5(A)-(F) are explanatory views of regions of the circulation flow in the solid fuel burner, wherein FIG. 5(A) is an explanatory view of a configuration of Embodiment 1, and FIG. 5(B) is an explanatory view of a configuration of Comparative Example 1 (Patent Documents 3 to 5), FIG. 5(C) is an explanatory view of a configuration of Comparative Example 2, FIG. 5(D) is an explanatory view of a configuration of Comparative Example 3 (Patent Documents 1 and 2), FIG. 5(E) is an explanatory view of the velocity of secondary air in cross sections of base end portions of the flame stabilizers, and FIG. 5(F) is an explanatory view of sizes in the regions of circulation flow.

FIGS. 6(A)-(F) are explanatory views of modifications of the contraction forming member, wherein FIG. 6(A) is an explanatory view of Modification 1, FIG. 6(B) is an explanatory view of Modification 2, FIG. 6(C) is an explanatory view of Modification 3, FIG. 6(D) is an explanatory view of Modification 4, FIG. 6(E) is an explanatory view of Modification 5, and FIG. 6(F) is an explanatory view of Modification 6.

DESCRIPTION OF EMBODIMENTS

Hereinafter, embodiments of the present invention will be described.

Figure 1A:
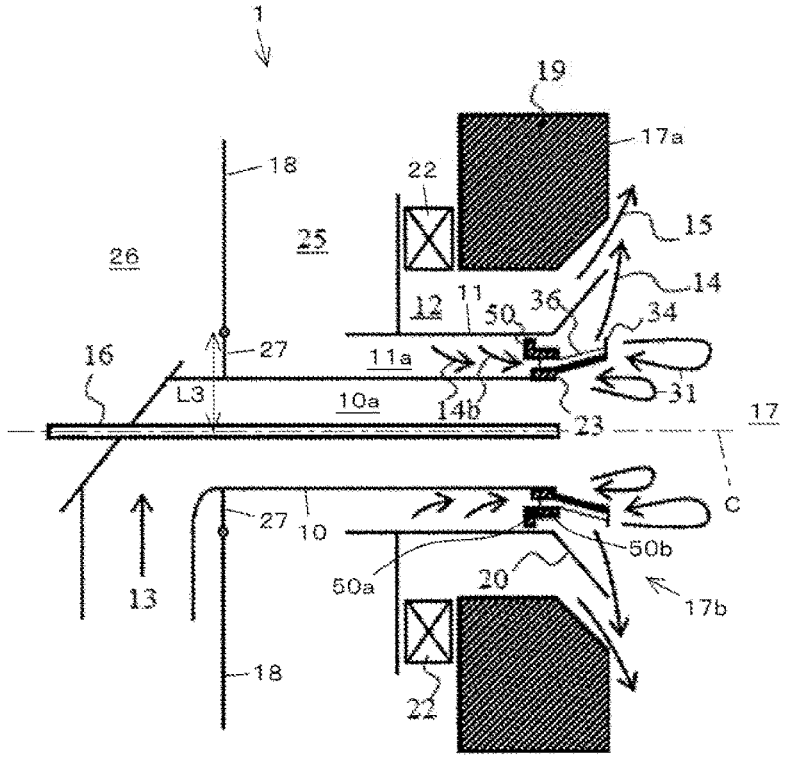
Figure 1B:
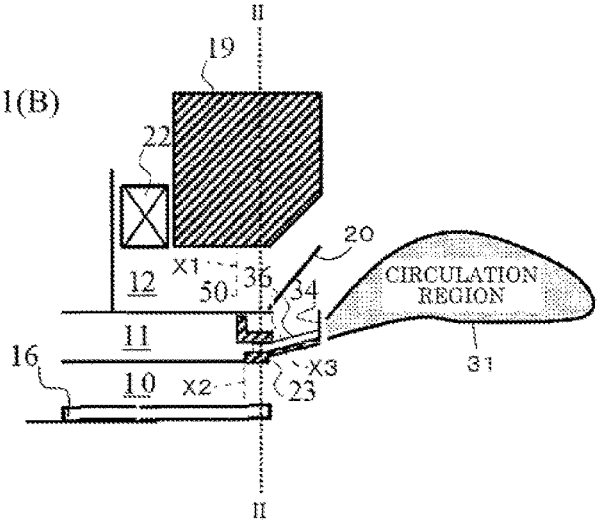
Figure 1C:
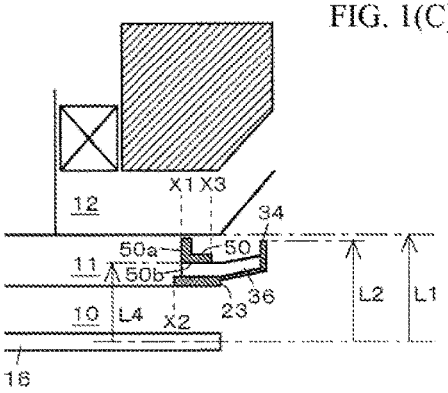

FIG. 1 is a side view (partial cross-section) of a solid fuel burner according to an embodiment of the present invention, wherein FIG. 1(A) is an overall view, FIG. 1(B) is an enlarged view of a tip portion, and FIG. 1(C) is an explanatory view of a positional relationship between respective parts of the tip portion.

Figure 2:
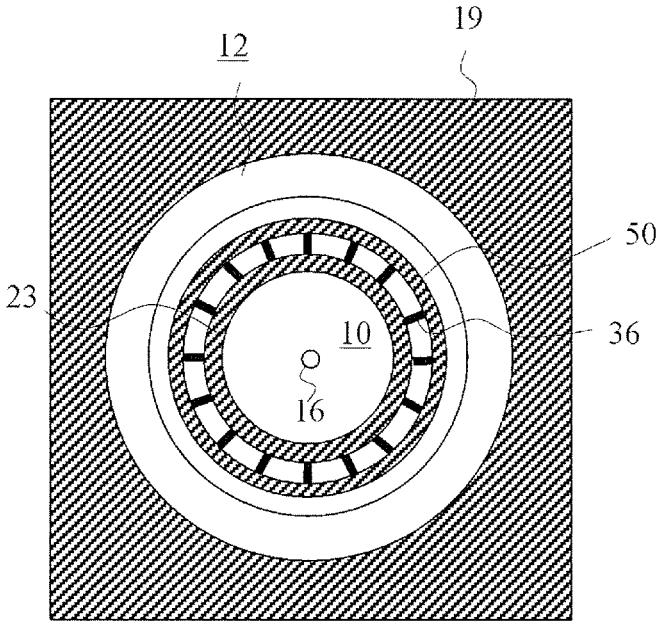
FIG. 2 is a cross-sectional view of the solid fuel burner taken on line II-II in FIG. 1(B).

FIG. 2 is a cross-sectional view of the solid fuel burner taken on line II-II in FIG. 1(B).

In FIG. 1, a solid fuel burner 1 according to Embodiment 1 of the present invention has a fuel nozzle (first gas nozzle) 10. The fuel nozzle 10 is a cylindrical member whose base side is connected to a fuel-containing fluid pipe (not illustrated), and has a flow passage 10*a* for solid-gas two-phase flow (mixed fluid 13) of solid fuel and a carrier gas (air is used in the present embodiment) formed inside thereof. In addition, the solid fuel is sprayed together with the carrier gas. The solid fuel may be solid or powders such as coal (pulverized coal) or biomass, or a mixture thereof. In the present embodiment, an example, in which the pulverized coal is used as the solid fuel and air is used as the carrier gas, is illustrated, and the carrier gas flowing in the fuel nozzle 10 is also referred to as a primary air 13, and the fuel nozzle 10 is also referred to as a primary air nozzle 10.

A secondary air nozzle (second gas nozzle) 11 forming a secondary air flow passage (second flow passage) 11*a* is provided on an outer periphery of the fuel nozzle 10, and a tertiary air nozzle (burner throat, third gas nozzle) 19 forming a tertiary air flow passage 12 is provided on an outer periphery of the secondary air nozzle 11. These secondary air 14 and tertiary air 15 are combustion gases, and air is commonly used similar to the carrier gas, but a combustion exhaust gas, oxygen-rich gas, or a mixed gas of two or more of these gases and air may be applied. Further, the secondary and the tertiary of the secondary air 14 and the tertiary air 15 are used only to distinguish them from the primary air 13.

When seeing the fuel nozzle 10, the secondary air nozzle 11, and the tertiary air nozzle 19 from a front of a burner outlet side (furnace 17 side), the annular secondary air nozzle 11 is disposed on an outside of the fuel nozzle 10 around the same concentrically, and the annular tertiary air nozzle 19 is disposed on an outside of the secondary air nozzle 11 concentrically. The tertiary air nozzle 19 forms the outermost air nozzle.

Further, in Embodiment 1, a swirler 22 for imparting swirl to the fluid is disposed at an inlet portion of the tertiary air flow passage 12, but it is also possible to employ a configuration in which the swirler 22 is not provided.

An ignition burner (oil gun) 16 penetrating the fuel nozzle 10 is provided inside the fuel nozzle 10, and is used for auxiliary combustion at the time of start of the burner or low-load combustion. Further, the ignition burner 16 may not be installed depending on the configuration of the solid fuel burner 1.

A flame stabilizer 23 for enlarging a circulation flow 31 between the primary air 13 and the secondary air 14 is provided at an opening end portion (=outlet on the furnace 17 side) of the fuel nozzle 10. The flame stabilizer 23 is provided in a ring shape at the tip portion of the fuel nozzle 10 so as to form the circulation flow 31 on the downstream side of the flame stabilizer 23 to increase ignitability and the flame stability. In addition, a configuration in which shark tooth-shaped protrusions are formed on the fuel nozzle 10 side may also be used.

The ignition burner 16, the fuel nozzle 10, the secondary air nozzle 11 and the tertiary air nozzle 19 spray respective spraying fluids from a furnace opening part 17*b* provided in a wall 17*a* of the furnace 17 (which is formed by a water pipe (not illustrated)) toward the inside furnace 17. In addition, the ignition burner 16, the fuel nozzle 10, the secondary air nozzle 11 and the tertiary air nozzle 19 are provided in a wind box 25 which surrounds the furnace opening part 17*b* and supplies pulverized coal or combustion air from a combustion air flow passage (not illustrated). A partition wall 18 is a wall-shaped member that isolates an inner space of the wind box 25 from an outside of the furnace 26. A front plate 27 of the partition wall 18, on which the fuel nozzle 10 is installed, is supported on the partition wall 18 to be attachable/detachable by bolts, screws, hooks and the like, so as to be pulled out integrally with the fuel nozzle 10 at the time of maintenance of the burner.

In addition, a guide sleeve (second guide member) 20 (having an end-spreading shape) is provided at an outlet tip of the secondary air nozzle 11 to expand the burner in a radial direction with respect to a central axis C thereof. In Embodiment 1, the secondary air nozzle 11 and the guide sleeve 20 are formed in an integral structure. By the guide sleeve 20, an airflow is guided and sprayed outward so as to be separated from the burner central axis C.

The flame stabilizer 23 is formed in a conical wall shape which is inclined radially outward with respect to the central axis C of the ignition burner 16 toward inside the furnace 17. A ring-shaped guide ring (guide member) 34 extending radially outward is disposed on an outer peripheral portion of the tip of the flame stabilizer 23. The guide ring 34 deflects the secondary air 14 radially outward to be sprayed.

As shown in FIGS. 1 and 2, in the flame stabilizer 23 of Embodiment 1, plate-shaped fin members 36 extending in a flow direction of the secondary air 14 are supported in the secondary air flow passage 11*a*. A plurality of fin members are disposed at an interval in a circumferential direction of the flame stabilizer 23, and are made of radial plate materials. The fin members 36 rectify the secondary air disturbed by colliding with an upstream end of the flame stabilizer 23.

A contraction forming member 50 is disposed on an upstream side of the fin member 36. The contraction forming member 50 has an upstream wall part 50*a* which extends in the radial direction with respect to the burner central axis C, and a cylindrical wall part 50*b* which extends from an inner end of the upstream wall part 50*a* in the radial direction to a downstream side in the flow direction of the secondary air 14. Thereby, the contraction forming member 50 of Embodiment 1 has a cross section formed in an L shape in an axial direction to form an annular gas flow passage.

Further, the contraction forming member 50 of Embodiment 1 has the cylindrical wall part 50*b* formed therein to be fixedly supported by the fin member 36. Thereby, the contraction forming member 50 is configured to capable of being moved integrally with the fin member 36. Further, a minute gap or an allowance enough to capable of moving the contraction forming member 50 is formed between it and the secondary air nozzle 11. Furthermore, it is also possible to employ a configuration in which the minute gap is filled with a fireproof material so that the secondary air 14 does not leak. In addition, it is also possible to adjust a size of the gap so that the gap is filled by thermal expansion during use of the solid fuel burner 1 and the gap is formed by thermal contraction due to cooling before maintenance.

Figure 3:
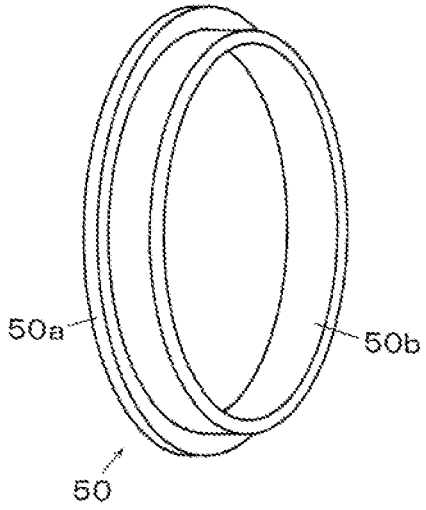
Figure 3:
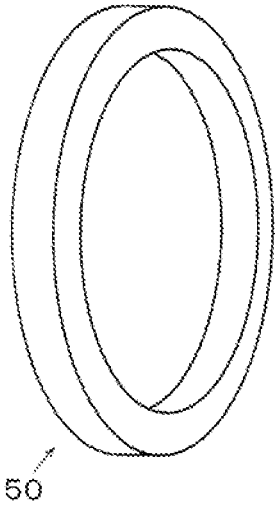

FIG. 3 are explanatory views of contraction forming members of embodiments, wherein FIG. 3(A) is an explanatory view of the contraction forming member of Embodiment 1, and FIG. 3(B) is an explanatory view of a contraction forming member of another embodiment.

Particularly, in Embodiment 1, the contraction forming member 50 is installed on the outer peripheral side of the flow passage of the secondary air nozzle 11, such that the flow direction is once throttled to a radial central axis direction (that is, a cross-sectional area of the second flow passage is narrowed), and then the flow direction is reversed to form a flow expanding outward. Further, the contraction forming member 50 of Embodiment 1 is supported by a member separated from the secondary air nozzle 11 from the flame stabilizer 23 side.

In FIG. 3(A), the contraction forming member 50 of Embodiment 1 is formed of an integral (collective) member having a uniform annular shape (ring shape) in the entire circumferential direction. Furthermore, it is also possible to form a shape shown in FIG. 3(B).

As shown in FIG. 3, the contraction forming member 50 is preferably formed of one member which is not partitioned in the circumferential direction, but it is also possible to employ a configuration in which the contraction forming member can be divided into a plurality of parts in the circumferential direction. Further, the contraction forming member 50 is preferably formed integrally with the flame stabilizer 23. The flame stabilizer 23 is generally a cast, and the contraction forming member 50 may be manufactured integrally with the flame stabilizer 23.

Furthermore, as shown in FIG. 1(C), in the central axis direction of the nozzle, when a position of a starting end portion (upstream end portion) of the upstream wall part 50*a* in the contraction forming member 50 is set to be X1, a position of a starting end portion (upstream end portion) of a portion of the flame stabilizer 23 attached to the fuel nozzle is set to be X2, and a position of a terminal end portion (downstream end portion) of the cylindrical wall part 50*b* in the contraction forming member 50 is set to be X3, in the same figure, X2, X1 and X3 are arranged from the upstream side in this order. Further, it is possible to arrange the position X1 on the upstream side (outside of the furnace) from the position X2, but even in this case, it is appropriate to arrange the position X3 on the downstream side (inside the furnace) from the position X2.

In addition, in relation to a positional relationship between X1, X2 and X3, it is preferable to configure in such a way that X1 is set on the upstream side of the secondary air flow as much as possible, and X1, X2 and X3 are arranged from the upstream side in this order.

That is, as described above, when the minute gap or allowance is formed between the contraction forming member 50 and the secondary air nozzle 11 enough to capable of moving the contraction forming member 50 with respect to the secondary air nozzle 11, a flow of a small amount so that the secondary air short passes through the gap may occur. This flow is a flow so as to go straight in the axial direction of the nozzle. This flow may hinder the flow of the secondary air deflected outward and sprayed by the guide ring 34 disposed at the tip portion of the flame stabilizer 23.

If X1 is set on the downstream side of the secondary air flow (secondary air nozzle 11) at a portion near the nozzle opening end, such an operation works strongly. On the other hand, if X1 is set on the upstream side, the short pass flow is attenuated and the operation thereof may be weakened.

In Embodiment 1, a length L2 of the guide ring 34 and the contraction forming member 50 on a large outer diameter side is set to be smaller than an inner diameter L1 of the secondary air nozzle 11 (L2<L1). In addition, in Embodiment 1, the outer diameter of the guide ring 34 and the outer diameter of the contraction forming member 50 are set to the same outer diameter L2. Further, in Embodiment 1, the length L2 is set to be smaller than an outer diameter (inner diameter of the partition wall 18) L3 of the front plate 27 (L2<L3). Furthermore, in Embodiment 1, an inner diameter (a distance between the central axis and the cylindrical wall part 50*b*) L4 of the contraction forming member 50 is set to be smaller than the outer diameter (L2) of the guide ring 34 (L2>L4). That is, in Embodiment 1, it is set to be L1>L2>L4.

Therefore, it is configured in such a way that, when the front plate 27 is removed from the partition wall 18 and the fuel nozzle 10 is pulled out, the fuel nozzle 10 and the flame stabilizer 23, the guide ring 34, the fin members 36, and the contraction forming member 50 can be integrally pulled out toward the outside 26 of the furnace. Further, if the contraction forming member 50 can be pulled out to a certain extent inside the furnace (in the wind box 25) from the partition wall 18 without completely drawing out the fuel nozzle 10 and the like, the outer diameter L3 of the front plate 27 may also be set to be smaller than the length L2, and it is also possible to employ a configuration in which the fuel nozzle 10 can be moved with respect to the partition wall 18 without providing the front plate 27.

(Operation of Embodiment 1)

Figure 4:
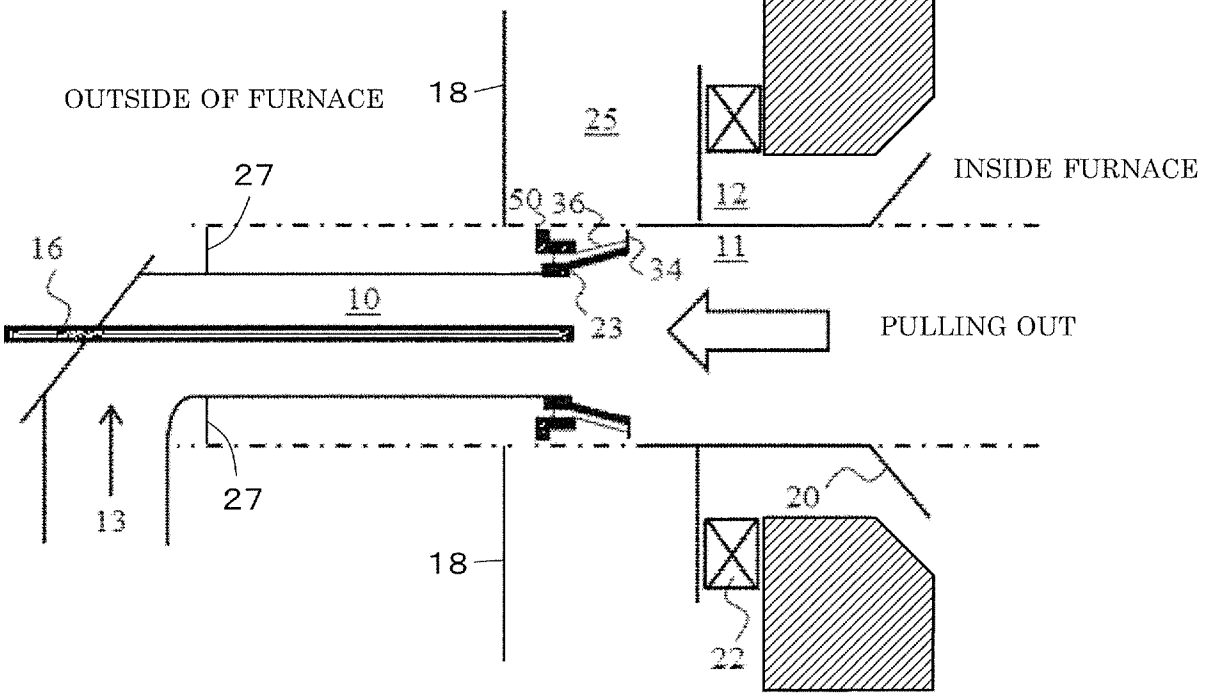
FIG. 4 is an explanatory view of a state in which a first gas nozzle portion is pulled out in tote solid fuel burner of Embodiment 1.

FIG. 4 is an explanatory view of a state in which a first gas nozzle portion is pulled out in the solid fuel burner of Embodiment 1.

In the solid fuel burner 1 of Embodiment 1 having the above-described configuration, as described above, the outer diameters L2 of the guide ring 34 and the contraction forming member 50 are set to be smaller than the inner diameter L1 of the secondary air nozzle 11. In a process of disassembling the solid fuel burner 1 for a regular inspection of the boiler, the guide ring 34 can be pulled out together with the fuel nozzle 10, and the like without being caught by the secondary air nozzle 11. Therefore, unlike the configurations described in Patent Documents 1 and 2, a process of installing a scaffold inside the furnace 17, or the like is not required, and maintainability is improved.

Further, even if it is possible to pull out the guide ring 34 together with the fuel nozzle 10, and the like without being caught by the secondary air nozzle 11, by simply setting the outer diameter L2 of the guide ring 34 to be smaller than the inner diameter L1 of the secondary air nozzle 11, deflection of the secondary air in the radial direction is weak, the circulation flow 31 is reduced, and the stability of the flame is also impaired. On the other hand, in Embodiment 1, the contraction forming member 50 is disposed on the upstream side of the guide ring 34. Therefore, the secondary air 14 has a high velocity when passing through the contraction forming member 50, collides with the guide ring 34 at a high speed, and is deflected radially outward. Thereby, in the configuration of Embodiment 1, even if setting the outer diameter L2 of the guide ring 34 to be small, the deflection of the sprayed secondary air 14 in the radial direction becomes strong, and the circulation flow 31 is secured. As a result, the flame is stabilized, and burnout of the flame stabilizer 23 is prevented.

Figure 5A:
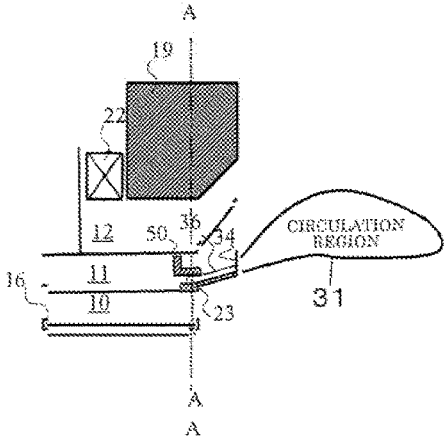
Figure 5D:
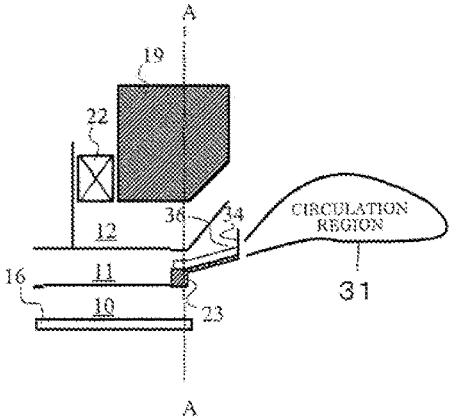
Figure 5B:
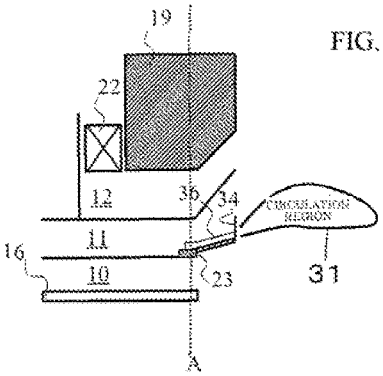
Figure 5B:
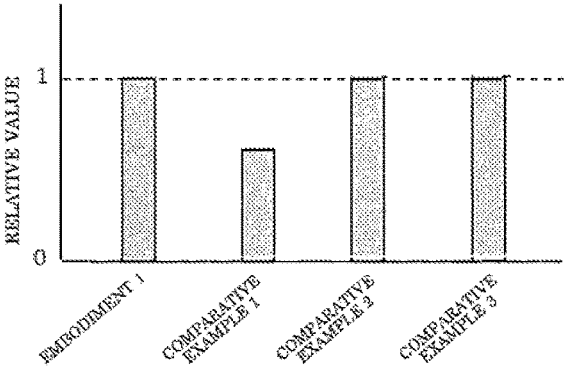
Figure 5C:
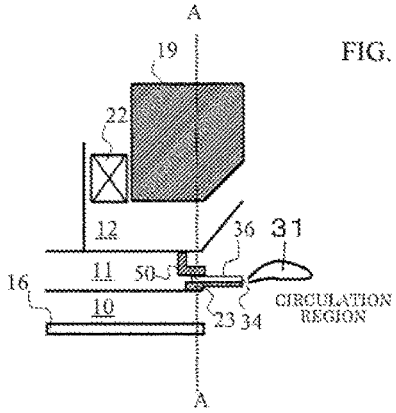
Figure 5C:
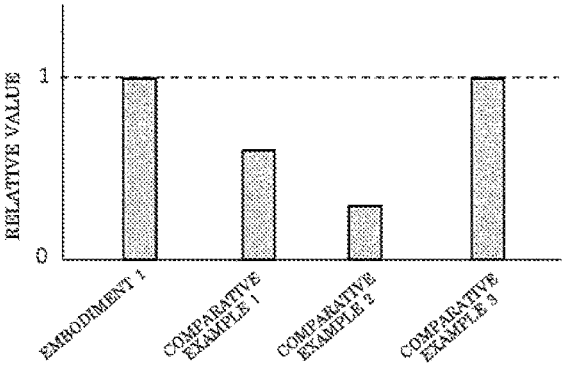

FIG. 5 is explanatory views of regions of the circulation flow in the solid fuel burner, wherein FIG. 5(A) is an explanatory view of a configuration of Embodiment 1, and FIG. 5(B) is an explanatory view of a configuration of Comparative Example 1, FIG. 5(C) is an explanatory view of a configuration of Comparative Example 2, FIG. 5(D) is an explanatory view of a configuration of Comparative Example 3, FIG. 5(E) is an explanatory view of the velocity of secondary air in cross sections of base end portions of the flame stabilizers, and FIG. 5(F) is an explanatory view of sizes in the regions of circulation flow.

In FIGS. 5(A) and 5(D), in the solid fuel burner 1 of Embodiment 1, by disposing the contraction forming member 50 on the upstream side of the guide ring 34, even if the outer diameter L2 of the guide ring 34 is smaller than that of Comparative Example 3, it is possible to secure the same region (NOx reduction region) of the circulation flow 31 as that of Comparative Example 3.

In FIGS. 5(A), 5(B), 5(E) and 5(F), in Comparative Example 1, similar to Embodiment 1, the flow passage configuration of the secondary air nozzle 11 is configured so that the flow of the combustion gas (secondary air) does not go straight and penetrate from the upstream side of the secondary air nozzle 11 toward the furnace side. However, in Comparative Example 1, unlike Embodiment 1, since the contraction forming member 50 is not provided, there is a problem that the velocity of the secondary air becomes slower than those of Embodiment 1 and Comparative Example 3, and the region of the circulation flow 31 becomes small.

Further, in FIGS. 5(C), 5(E) and 5(F), in Comparative Example 2, the contraction forming member 50 is provided, but the outer diameter of the guide ring 34 is small (L4>L2). Thereby, unlike Embodiment 1, in the flow passage configuration of the secondary air nozzle 11, since the flow of the combustion gas (secondary air) easily goes straight and penetrates from the upstream side of the secondary air nozzle 11 toward the furnace side, even if the velocity of the secondary air is high, there is a problem that the region of the circulation flow 31 becomes small.

Further, in FIGS. 5(A) and 5(D), in Comparative Example 3, the contraction forming member 50 is not provided, but unlike Embodiment 1, the outer diameter L2 of the guide ring 34 is larger than the inner diameter L1 of the secondary air nozzle 11 (L2>L1). Therefore, in the flow passage configuration of the secondary air nozzle 11, it is difficult for the flow of the combustion gas (secondary air) to go straight and penetrate from the upstream side of the secondary air nozzle 11 toward the furnace side. However, since it is L2>L1, the guide ring 34 is not caught by the secondary air nozzle 11 and the fuel nozzle 10 cannot be pulled out.

(Description of difference from Patent Document 1) Further, FIG. 11 (a tenth embodiment) of Patent Document 1 illustrates that a narrow portion (65) is formed. However, paragraph number [0064] in the specification of Patent Document 1 describes that "a guide sleeve 12 in a secondary air nozzle 11 is provided with a plurality of narrow portions 65 for narrowing the flow passage with respect to the direction of air flow in the circumferential direction," and it is not clear whether it is an annular member as in Embodiment 1 of the present invention, that is, a uniform collective member in the entire circumferential direction.

In addition, in Embodiment 1, the contraction forming member 50 is supported from and fixed to the fuel nozzle 10 side and can be separated from the secondary air nozzle 11, but in Patent Document 1, it cannot be read that the member for providing the plurality of narrow portions (65) in the circumferential direction is separable, from the drawings and the related description of the member.

Therefore, in the configuration described in Patent Document 1, if a relationship between an inner diameter of the narrow portion (65) corresponding to the length L4 of Embodiment 1 and an outer diameter of the guide plate/ring (30) corresponding to the length L2 was L4<L2, when trying to pull out the guide plate/ring (30) integrally with the fuel nozzle toward the outside of the furnace, it is not possible to pass through the narrow portions (65).

Further, in Embodiment 1, as a deflection member for deflecting the secondary air 14 radially outward and spraying, the ring-shaped guide ring (guide member) 34 extending radially outward is disposed at the tip portion of the flame stabilizer 23 having the portion formed in a conical wall shape, but it is not described in Patent Document 5. In FIGS. 1, 3, 5, 6 and 9 of Patent Document 5, a member corresponding to the flame stabilizer 23 of Embodiment 1 having the portion formed in a conical wall shape is seen, but the deflection member corresponding to the guide ring of the invention is not shown.

(Description of Difference from Patent Document 5)

A venturi (21) in FIGS. 1, 3, 5, 6 and 9 of Patent Document 5 is similar to the contraction forming member 50 of Embodiment 1 in an aspect that a flow passage of a secondary air nozzle (11) is narrowed toward a central axis side of the nozzle.

However, both differ in at least the following two aspects.

1) Relationship (supporting form of member) between (contraction forming) member and secondary air nozzle.

Regarding an aspect that the contraction forming member 50 is supported from/fixed to the fuel nozzle 10 side and is separable from the secondary air nozzle 11 in Embodiment 1, the venturi (21) of Patent Document 5 does not include such a description in the drawings and the related description thereof.

2) Form of flow passage (flow of secondary air) on downstream side once forming a contracted flow The venturi (21) of Patent Document 5 is provided with a conical wall portion configured so that the flow passage gradually expands toward an outer peripheral side.

That is, it is configured so that the flow of the secondary air on the downstream side of the venturi (21) is uniform in the radial direction of the nozzle.

On the other hand, in Embodiment 1, the flow once contracted is collided with the guide ring (guide member) 34 provided in the front before the flow does not spread radially outward of the secondary air nozzle 11, and thereby, it differs from the above configuration in an aspect that the secondary air is deflected radially outward and sprayed.

Therefore, the relationship between the inner diameter L4 of the contraction forming member 50 and the outer diameter L2 of the guide ring 34 is L4<L2.

In Patent Document 5, it is not clear whether the relationship between an inner diameter of the venturi (21) corresponding to the length L4 and a length of the portion corresponding to the length L2 is L4<L2. If assuming that it is L4<L2 (because it is not clear whether the venturi (21) is separable from the secondary air nozzle and is supported from/fixed to the fuel nozzle side), when trying to pull out the member corresponding to the flame stabilizer integrally with the fuel nozzle toward the outside of the furnace, the member interferes with the venturi (21).

On the other hand, in the solid fuel burner 1 of Embodiment 1 having the above-described characteristics, since the NOx reduction region associated with the region of the circulation flow 31 is also formed equal to the cases of Patent Documents 1 and 2, it is also possible to achieve low NOx performance equal to the conventional one while improving the maintainability.

Particularly, in Embodiment 1, the fin member 36 is disposed on the downstream side of the contraction forming member 50, and the secondary air 14 collides with the guide ring 34 in a rectified state. Therefore, since the secondary air 14 that has collided with the contraction forming member 50 or the flame stabilizer 23 and has been disturbed collides with the guide ring 34 in the rectified state, the deflection in the radial direction is strong, and the formation of the circulation flow 31 is easily promoted compared to the case of not being rectified. Thereby, as compared to the case in which the fin member 36 is not provided, the flame is easily stabilized, and burnout of the flame stabilizer 23 is prevented.

Figure 6:
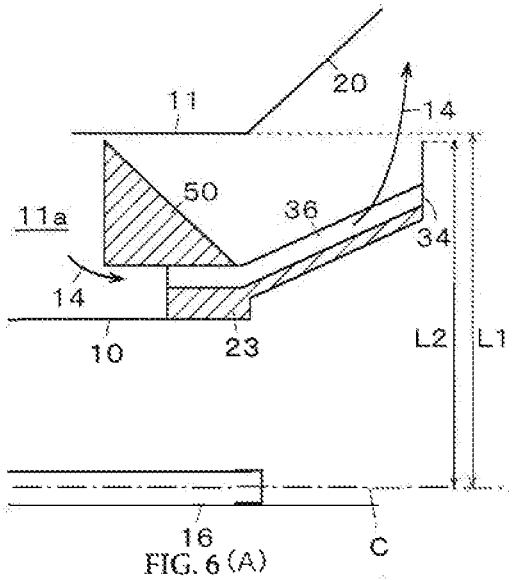
Figure 6:
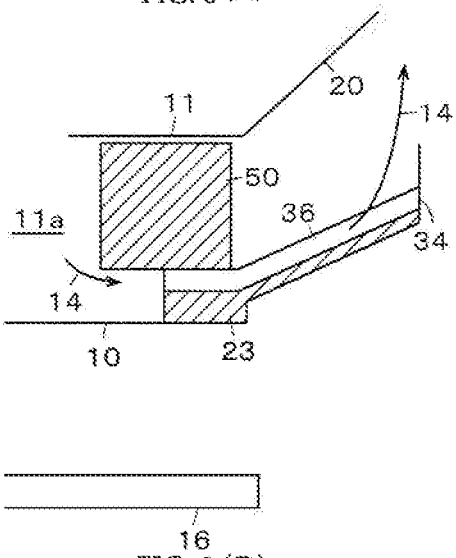
Figure 6:
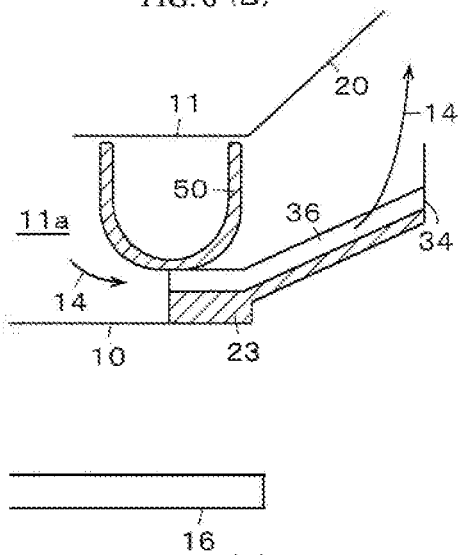
Figure 6:
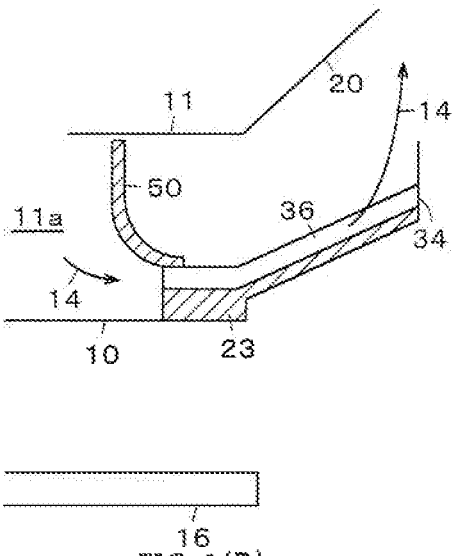
Figure 6:
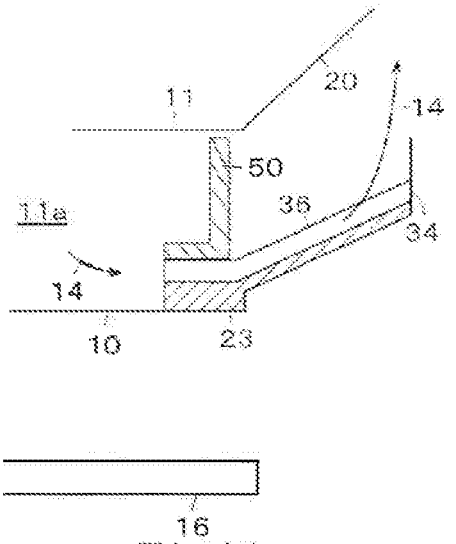
Figure 6:
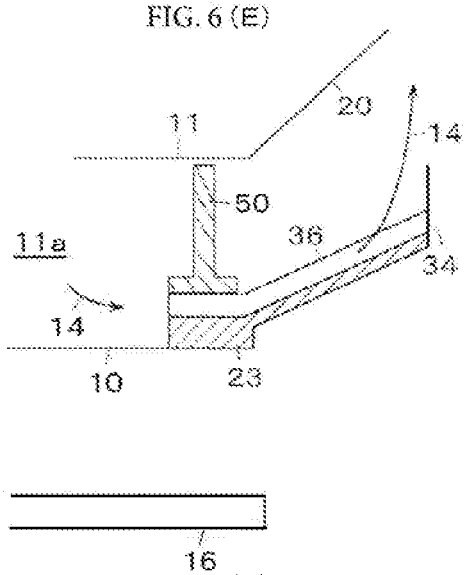

FIG. 6 is explanatory views of modifications of the contraction forming member, wherein FIG. 6(A) is an explanatory view of Modification 1, FIG. 6(B) is an explanatory view of Modification 2, FIG. 6(C) is an explanatory view of Modification 3, FIG. 6(D) is an explanatory view of Modification 4, FIG. 6(E) is an explanatory view of Modification 5, and FIG. 6(F) is an explanatory view of Modification 6.

In FIG. 6, the shape of the contraction forming member 50 is not limited to the L-shaped cross section shown in FIG. 1, and it may be formed in a triangular cross section shown in FIG. 6(A), a quadrangular cross section as shown in FIG. 6(B), a U-shaped cross section as shown in FIG. 6(C), or a 90-degree arc cross section as shown in FIG. 6(D). Further, the contraction forming member may be formed in any shape capable of forming a contracted flow, such as a horizontally reversed L-shape as shown in FIG. 6(E), a vertically reversed T-shape as shown in FIG. 6(F) and the like.

As shown in FIGS. 6(B) and 6(C), if the gap or allowance between the contraction forming member 50 and the secondary air nozzle 11 has a form so as to be formed long or doubly formed, a pressure loss in the gap is large, and it is suitable for suppressing the short passing flow of the secondary air flowing therethrough (as described above).

Meanwhile, when the gap between the contraction forming member 50 and the secondary air nozzle 11 can be adjusted to be narrow, it is not limited thereto. For example, when the burner capacity is small, that is, when the burner size is small, the gap is relatively small, and the burner can be accurately manufactured. Therefore, the short passing flow through the above-described gap is suppressed, and an influence on the flow 14 of the secondary air that is deflected outward and sprayed is also suppressed. In such a case, the contraction forming members 50 illustrated in FIGS. 6(E) and 6(F) may also be selected. Since these examples have a simpler structure than the examples of FIGS. 6(A) to (D), they may be easily manufactured and the apparatus costs may be reduced.

(Other Modifications)

In the above description, the embodiment of the present invention has been described in detail, but it is not limited to the above embodiment, and it is possible to perform various changes within the scope of the purport of the present invention described in claims. Modifications (H01) to (H03) of the present invention will be exemplified below.

(H01) In the above embodiments, it is preferable to have a configuration in which the contraction forming member 50 is supported by the fin member 36 in an aspect that the number of components is not increased, but it is not limited thereto. For example, it is possible to employ a configuration in which a member (support, or stay) that supports the contraction forming member 50 is provided separately from the fin member 36, to support the contraction forming member 50. Thereby, it is preferable to employ a configuration in which the fin member 36 is provided, but it is also possible to employ a configuration which does not have the fin member.

(H02) In the above embodiments, it is also possible to employ a configuration in which the fuel nozzle 10 is provided with the fuel concentrator as in the configuration described in Patent Document 2.

(H03) In the above-described embodiments, the configuration of the burner, in which the fuel nozzle has an exact circular flow passage cross-sectional shape, has been described as an example, but it is not limited thereto. For example, it may also be applied to a burner having a flat flow passage cross-sectional shape (see Japanese Patent Publication No. 5832653).

INDUSTRIAL APPLICABILITY

The present invention has industrial applicability as a burner device using solid fuel.

REFERENCE SIGNS LIST

1 . . . Solid fuel burner,
10 . . . First gas nozzle,
10*a* . . . Flow passage through which mixed fluid flows,
11 . . . Second gas nozzle,
11*a* . . . Second flow passage,
14 . . . Secondary air,
25 . . . Wind box,
34 . . . Guide member,
36 . . . Fin member,
50 . . . Contraction forming member,
50*a* . . . Contraction forming member, upper wall part,
50*b* . . . Contraction forming member, lower wall part,
L1 . . . Inner diameter of outer peripheral wall of second gas nozzle,
L2 . . . Outer diameters of guide member and contraction forming member,
L3 . . . Diameter of front plate, primary nozzle extraction part,
L4 . . . Inner diameter of contraction forming portion.

The invention claimed is:

1. An solid fuel burner comprising:

a first gas nozzle having a cylindrical flow passage through which a mixed fluid of a solid fuel and a carrier gas of the solid fuel flows;

a second gas nozzle configured to form a second flow passage through which a combustion gas of the solid fuel flows, and is formed on an outer peripheral side of the first gas nozzle;

a guide member disposed on an outer peripheral portion of a tip of the first gas nozzle to guide a fluid flowing through the second flow passage radially outward; and a contraction forming member disposed on an upstream side of the guide member with respect to a flow direction of the second flow passage, to narrow a cross-sectional area of the second flow passage, wherein an outer diameter of the guide member is formed to be smaller than an inner diameter of an outer peripheral wall of the second gas nozzle, the first gas nozzle, the guide member, and the contraction forming member are configured to be integrally attachable/detachable toward an outside of the furnace in an axial direction of the first gas nozzle, a fin member which is disposed between the contraction forming member and the guide member to rectify the secondary air flowing through the second flow passage, and a contraction forming member supported by the fin member.

2. The solid fuel burner according to claim 1, wherein, when setting the inner diameter of the outer peripheral wall of the second gas nozzle to be L1, the outer diameter of the guide member to be L2, and an inner diameter of the contraction forming member to be L4, these diameters have a relationship as below:

L1>L2>L4.

3. A flame stabilizer provided at an opening end portion of a fuel nozzle of a solid fuel burner having a cylindrical first gas nozzle through which a mixed fluid of a solid fuel and a carrier gas flows and a second gas nozzle disposed on an outer peripheral side of the first gas nozzle, the flame stabilizer for the solid fuel burner comprising:

an annular contraction forming member configured to reduce a flow passage for a combustion gas which flows on an outer peripheral side of the flame stabilizer inward from an outside;

a plurality of fin members which extend in a direction along a flow of the combustion gas and are provided in the flame stabilizer in a circumferential direction thereof; and a guide member provided to deflect the flow of the combustion gas passing through the annular contraction forming member outward, wherein an outer diameter of the guide member is larger than an inner diameter of the annular contraction forming member, the first gas nozzle, the guide member, and the contraction forming member are configured to be integrally attachable/detachable toward an outside of the furnace in an axial direction of the first gas nozzle, the fin members which are disposed between the contraction forming member and the guide member to rectify the secondary air flowing through the second flow passage, and the contraction forming member supported by the fin member.

4. A flame stabilizer provided at an opening end portion of a fuel nozzle of a solid fuel burner, the flame stabilizer for the solid fuel burner comprising:

an annular contraction forming member configured to reduce a flow passage for a combustion gas which flows on an outer peripheral side of the flame stabilizer inward from an outside;

a plurality of fin members which extend in a direction along a flow of the combustion gas and are provided in the flame stabilizer in a circumferential direction thereof; and a guide member provided to deflect the flow of the combustion gas passing through the annular contraction forming member outward, wherein an outer diameter of the guide member is larger than an inner diameter of the annular contraction forming member, the fin members which are disposed between the contraction forming member and the guide member to rectify the secondary air flowing through the second flow passage, and the contraction forming member supported by the fin member.

* * * * *